United States Patent [19]

Hardin et al.

[11] 4,355,624

[45] Oct. 26, 1982

[54] FUEL BURNING HEATER

[76] Inventors: James C. Hardin, 1261 Westbrook Cir.; Gerald D. Hardin, Rte. 1, Box 523, Sparrow Springs Rd., both of Gastonia, N.C. 28052

[21] Appl. No.: 127,783

[22] Filed: Mar. 6, 1980

[51] Int. Cl.[3] ..... F24B 3/00

[52] U.S. Cl. ..... 126/66; 126/77; 126/285 A; 126/289

[58] Field of Search ..... 126/67, 63, 65, 68, 126/121, 285 A, 83, 289, 77, 290, 66, 292, 293

[56] References Cited

U.S. PATENT DOCUMENTS

| | | | |
|---|---|---|---|
| 144,469 | 11/1873 | Moore | 126/285 A |
| 843,773 | 2/1907 | Stanford | 126/285 A |
| 2,703,567 | 3/1955 | Manchester et al. | 126/121 |
| 4,147,153 | 4/1979 | Buckner | 126/121 |
| 4,166,444 | 9/1979 | Martenson | 126/121 |
| 4,201,185 | 5/1980 | Black | 126/67 |

*Primary Examiner*—James C. Yeung

*Attorney, Agent, or Firm*—Bell, Seltzer, Park & Gibson

[57] ABSTRACT

A forced air, fuel burning heater is provided which includes a relatively large damper plate slideably mounted immediately below the top wall of the heater, to thereby insulate the top wall from the heat of combustion and thereby reduce the temperature and thus the tendency of the top wall to warp from excessive heat. The damper plate preferably includes a rearward edge which is doubled upon itself to further insulate the edge of the flue opening in the top wall from heat, where warpage commonly occurs. The disclosed heater also includes a separate blower assembly which may be selectively mounted on either side of the combustion chamber with equally effective air circulation, and the hearth plate includes an upwardly inclined forward edge portion for reflecting radiant heat back toward the heater and thus reducing the temperature of the adjacent floor surface.

5 Claims, 4 Drawing Figures

FUEL BURNING HEATER

The present invention is directed to a forced air, fuel burning heater, which may be designed either as a free standing unit or as an insert to be mounted within the opening of a conventional masonry fireplace.

In recent years, wood burning heaters have become increasingly popular by reason of the scarcity and increasing cost of hydrocarbon fuels. Typically, these heaters are of sheet metal construction, and have inner walls defining a combustion chamber and outer walls defining an enclosed airspace surrounding the side and back walls of the combustion chamber. The top wall of the heater includes a flue opening to permit the escape of the smoke, and a blower is mounted on the outer back wall of the heater to force air through the airspace and outwardly into the room through openings in the front wall. A heater of this general type is disclosed in the U.S. Pat. to Buckner, Nos. 4,092,976 and 4,147,153.

When a fuel is burned in a heater of the above-described type, it will be apparent that the top wall will become quite hot, since it directly overlies the burning fuel. As a result, it is common for the top wall to warp from the heat, particularly along the forward edge of the flue opening. Such warpage is not only unsightly, but it can result in the separation of the connection between the flue opening and flue stack, to thereby permit smoke to leak into the room. The front wall of the heater also becomes very hot, which is desirable in the sense that the heat of the front wall readily radiates into the room, but it is undesirable in the sense that it may become so hot as to cause the floor surface immediately in front of the heater to ignite.

A further problem associated with conventional heaters of the described type is the fact that the blower becomes excessively hot, which can result in the deterioration of the electrical components. Further, the positioning of the blower on the back wall of the heater renders access difficult for servicing, particularly where the unit is mounted within a fireplace.

It is accordingly an object of the present invention to provide a fuel burning heater of the described type which effectively overcomes the above noted disadvantages of the present heaters.

It is a more particular object of the present invention to provide a fuel burning heater wherein the temperature of the top wall is minimized, to effectively eliminate warpage or other deterioration thereof.

It is another object of the present invention to provide a fuel burning heater of the above type, and wherein the blower is positioned at a location where it is readily accessible for servicing, and is effectively insulated from the heat of the burner to avoid the overheating thereof.

It is still another object of the present invention to provide a fuel burning heater having provision for reducing the temperature of the floor surface directly in front of the heater.

These and other objects and advantages of the present invention are achieved in the embodiment illustrated herein by the provision of a fuel burning heater which comprises a front wall, a back wall, opposite side walls, a bottom wall, and a top wall which collectively define an enclosed combustion chamber. The top wall includes a flue opening positioned adjacent the back wall, and there is provided a relatively flat damper plate having an overall area comparable to at least a substantial portion of that part of the area of the top wall within the combustion chamber forwardly of the flue opening. The damper plate is slideably mounted within the combustion chamber immediately below and parallel to the top wall, and for movement between a rearward position underlying and substantially closing the flue opening and a forward position wherein the damper plate is spaced forwardly of the flue opening and underlies substantially the full area of the top wall forwardly of the flue opening. Thus in the forward position, the damper plate serves as an effective heat barrier which is positioned between the burning fuel and the top wall of the heater, to thereby reduce the temperature of the top wall. The rearward side edge of the damper plate is preferably doubled upon itself, and such that a double thickness of the damper plate directly underlies the forward edge of the flue opening when the damper plate is in the forward position, to thereby further insulate the forward edge of the flue opening from the heat of combustion.

The heater also preferably includes a hearth plate extending forwardly from the front wall and below the access opening, and laterally along at least subtantially the full width of the front wall. The hearth plate includes a flat inner horizontal portion and a flat outer edge portion which is disposed at an upwardly inclined angle with respect to the horizontal portion, and whereby the outer edge portion acts to reflect radiant heat back toward the heater and thereby lower the temperature of the adjacent floor surface.

The heater further preferably includes an outer back wall and outer side walls respectively overlying in spaced relation the back and side walls of the combustion chamber so as to collectively define an enclosed airspace therebetween. An aperture is disposed in one of the outer side walls adjacent the front wall and communicates with the enclosed airspace, and an air outlet is provided in the front wall and communicates with the enclosed airspace. A blower is disposed adjacent and laterally spaced from said one outer side wall, and a hose operatively interconnects the output of the blower to the aperture. In addition, baffle means are disposed within the enclosed airspace for circulating the air entering the aperture over substantially the full area of the back wall and side walls before exiting through the air outlet in the front wall. Means are also provided whereby the blower may be selectively mounted adjacent the opposite outer side wall, and the baffle means is designed to achieve equally effective air circulation through the airspace with the blower mounted on either side.

Some of the objects having been stated, other objects will appear as the description proceeds, when taken in connection with the accompanying drawings in which FIG. 1 is a perspective view of a fuel burning heater embodying the features of the present invention;

Figure 1:
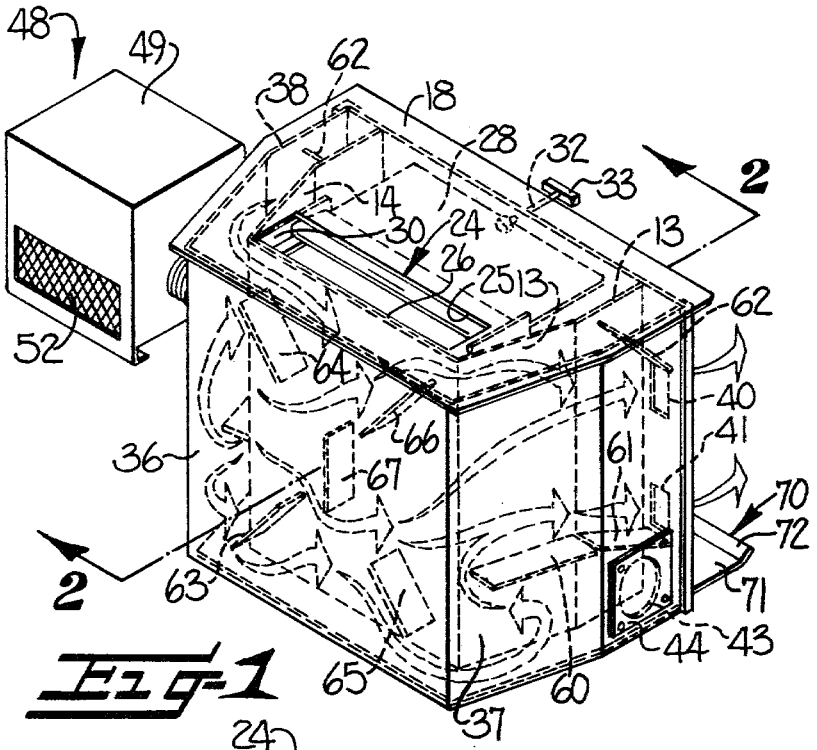

Referring more specifically to the drawings, there is illustrated a preferred embodiment of a fuel burning heater which incorporates the features of the present invention. The illustrated heater may be fabricated from conventional sheet metal materials, and includes a front wall 10, a back wall 12, opposite side walls 13 and 14, a bottom wall 16, and a top wall 18, which collectively define a combustion chamber. A layer of firebrick 19 is preferably disposed on the bottom wall 16 for heat insulating purposes.

Figure 2:
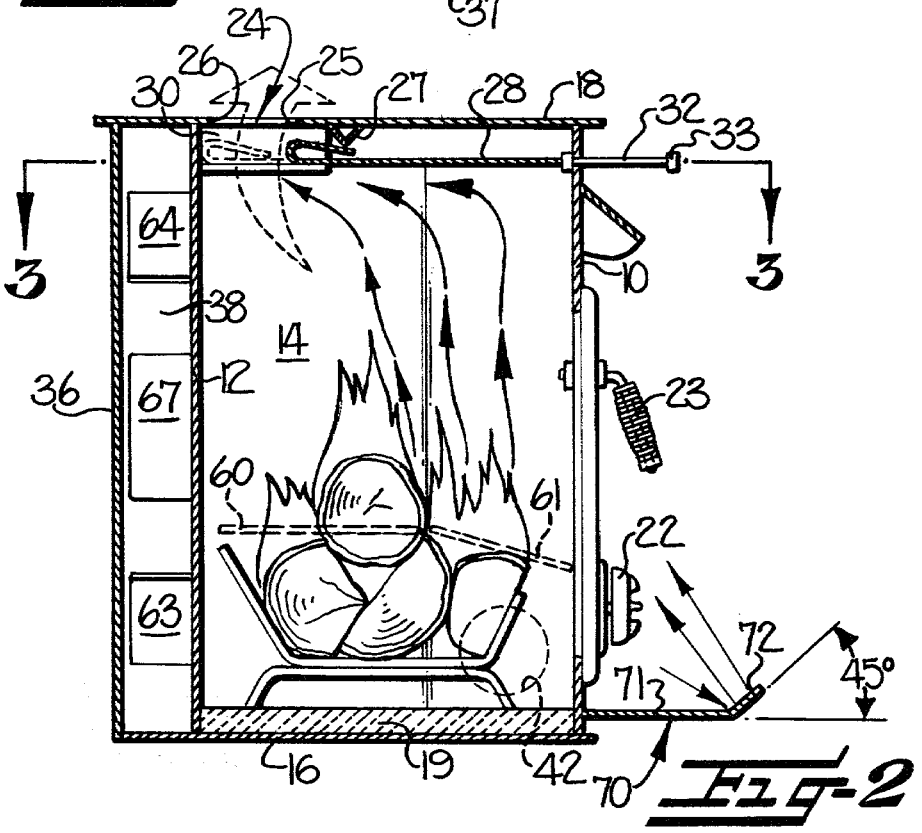
FIG. 2 is a sectional side elevation view of the heater taken substantially along the line 2—2 of FIG. 1.

The front wall 10 includes an access opening, which is normally closed by a pair of doors 20 and 21. The doors each include an air inlet control 22 of conventional design, and a handle 23. The top wall 18 includes a flue opening 24 for communication with a flue or the like, and to permit the escape of the smoke and other products of combustion. The opening 24 is rectangular in configuration and includes a straight forward side edge 25 and a rear side edge 26 which are disposed generally parallel to the front wall 10 and back wall 12. A laterally directed brace 27 (FIG. 2) formed of angle iron or the like may also be welded to the under side of the top wall forwardly of the opening 24 for reinforecement purposes.

Figure 3:
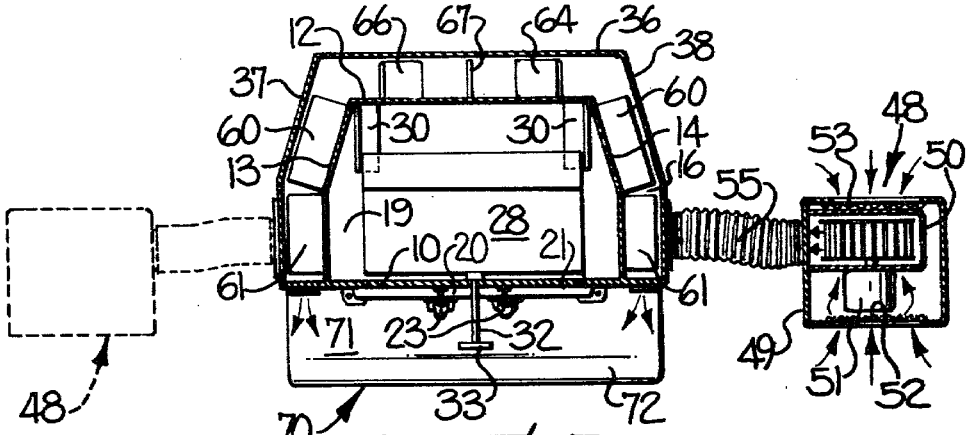
FIG. 3 is a sectional plan view of the heater taken substantially along the line 3—3 of FIG. 2, and also showing the interior of the blower assembly.
Figure 4:
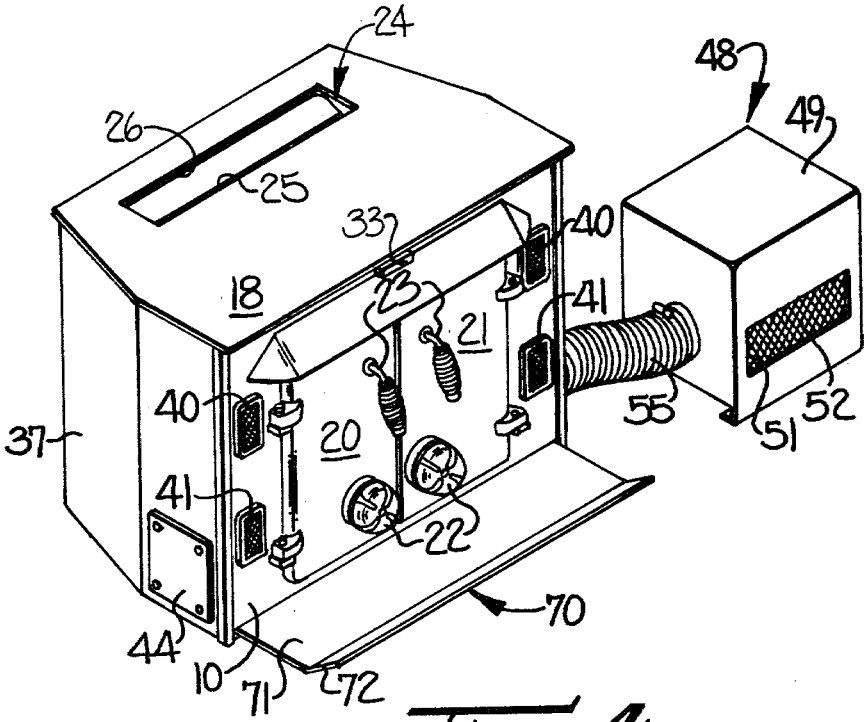
FIG. 4 is a front perspective view of the heater shown in FIG. 1.

The heater further includes a relatively flat, rectangular damper plate 28. As best seen in FIGS. 1 and 3, the damper plate has a size which is sufficient to underlie and cover the flue opening 24, and an overall area which is sufficient to cover at least a substantial portion of that part of the area of the top wall within the combustion chamber forwardly of the flue opening 24. Means are also provided for slideably mounting the damper plate within the combustion chamber immediately below and parallel to the top wall, and for movement between a rearward position (shown in dashed lines in FIG. 2) underlying and substantially closing the flue opening, and a forward position (shown in FIGS. 1—3) wherein the damper plate is spaced forwardly of the flue opening and underlies substantially the full area of the top wall forwardly of the flue opening. The means for thus slideably mounting the damper plate comprises a pair of forwardly directed angles 30, which are mounted to the under side of the top wall in a laterally spaced relation on opposite sides of the flue opening. The angles 30 thus supportingly receive the damper plate therebetween. In addition, a rod 32 is fixed to the forward edge of the damper plate and extends forwardly through an aperture in the front wall 10, and a handle 33 is fixed to the forward end of the rod. By this arrangement, the damper plate may be manually moved between the above described rearward and forward positions, to control the volume of heat and smoke rising through the flue opening 24.

The illustrated heater further comprises an outer back wall 36 and outer side walls 37, 38 which respectively overlie in spaced relation the back wall 12 and side walls 13 and 14 of the combustion chamber. As best seen in FIG. 1, the outer back wall 36 and outer side walls 37, 38 collectively define an enclosed airspace with the back wall 12, opposite side walls 13 and 14, front wall 10, bottom wall 16, and top wall 18. A pair of vertically spaced air outlets 40, 41 are disposed in the front wall on each side of the access opening, and communicate with the enclosed airspace. In addition, a first air inlet aperture 42 (FIG. 2) is disposed in the outer side wall 38 adjacent the lower front corner thereof so as to communicate with the enclosed airspace. A second air inlet aperture 43 (FIG. 1) is disposed in the outer side wall 37 adjacent the lower front corner thereof, and so as to be laterally aligned with respect to the first aperture 42. In addition, a cover plate 44 is mounted to the side wall 37 by bolts or the like so as to cover and close the aperture 43. As best seen in FIG. 1, the two air outlets 40, 41 on each side of the front doors are both disposed above the level of the apertures 42, 43.

A blower assembly 48 is disposed adjacent and laterally spaced from the outer side wall 38. More particularly, the blower assembly comprises a box-like container 49, having a blower 50 and electrical motor 51 positioned therein, note FIG. 3. The container 49 includes a pair of air inlet grilles 52, 53 on opposite sides thereof, with the grille 52 being positioned so that the air entering therethrough passes over the motor 51 of the blower to effectively cool the same. The output of the blower is innerconnected to the aperture 42 in the outer side wall 38 by a flexible metallic hose 55.

A plurality of baffle plates are disposed within the enclosed airspace for directing the air which enters the aperture 42 from the blower 50, over substantially the full area of the back wall 12 and side walls 13, 14, before exiting through the air outlets 40, 41 on each side of the doors 20, 21. More particularly, there is provided two horizontally disposed and aligned baffle plates 60, 61 positioned on each side wall above the associated aperture 42 or 43, and below the associated air outlet 41. An inclined baffle plate 62 is also mounted at the upper front corner of each side wall and immediately above the upper air outlet 40. The back wall 12 mounts four baffle plates 63, 64, 65 and 66 disposed in a spaced apart X-shaped arrangement, and a fifth vertically directed plate 67 is disposed at the midpoint of the X-shaped baffles, note FIG. 1.

In operation, the air entering the aperture 42 from the blower 50 is initially directed rearwardly along the lower portion of the side wall 14 by the baffle plates 60, 61, and upon entering the airspace along the rear wall, a portion of the air is directed upwardly and then back across the upper portion of the side wall 14 by the plates 63, 67 and 64, and so as to exit from the two outlet openings 40, 41 on the side adjacent the blower. Another portion of the airstream passes across the back wall and then across the opposite side 13 wall so as to exit from the outlets 40, 41 on the side opposite the blower.

The three plates 60, 61 and 62 on each side wall 13 and 14 are disposed in a mirror image of the corresponding plates on the other side wall. This arrangement permits the blower 48 assembly 50 to be selectively mounted on either side of the combustion chamber, with equally effective air circulation through the airspace, by simply connecting the hose 55 to the aperture 43 on the side wall 37, and mounting the cover plate 44 to close the aperture 42, note the position of the blower assembly shown in dashed lines in FIG. 3.

The heater of the present invention further includes a hearth plate 70 which extends forwardly from the front wall below the access opening, and laterally along the full width of the front wall. The hearth plate includes a flat inner horizontal portion 71 and a flat outer edge portion 72 which is upwardly inclined at an angle of about 45 degrees with respect to the horizontal direction, note FIG. 2. In cross section, the outer edge portion preferably has a forward length which is at least about one fourth the forward length of the inner portion, and as a typical example, the outer edge portion has a length of about two inches and the inner portion has a length of about eight inches. By this arrangement, the outer edge portion 72 serves as a reflector which reflects radiant heat back toward the heater, and thereby effectively lowers the temperature of the adjacent floor surface.

In the drawings and specification, there has been set forth a preferred embodiment of the invention, and although specific terms are employed, they are used in a generic and descriptive sense only and not for purposes of limitation.

That which is claimed is:

1. A fuel burning heater characterized as having a relatively low temperature on the top wall thereof so as to minimize warpage and deterioration of such wall, and comprising a front wall, a back wall, opposite side walls, a bottom wall, and a top wall collectively defining an enclosed combustion chamber, an access opening in said front wall to permit access to said combustion chamber, a flue opening in said top wall adjacent said back wall for communicating with a flue or the like, a relatively flat damper plate having an overall area comparable to at least a substantial portion of that part of the area of said top wall within said combustion chamber forwardly of said flue opening, and means slideably mounting said damper plate within said combustion chamber immediately below and parallel to said top wall, and for movement between a rearward position underlying and substantially closing said flue opening and a forward position wherein the damper plate is spaced forwardly of said flue opening and underlies a substantial portion of that part of the area of the top wall forwardly of said flue opening to thereby insulate the top wall from the heat of combustion within said combustion chamber, said mounting means including a rod fixed to said damper plate and extending forwardly through said front wall, and handle means fixed to said rod forwardly of said front wall.

2. The fuel burning heater as defined in claim 1 wherein said flue opening is generally rectangular and includes a straight forward side edge which is disposed generally parallel to said front wall, and said damper plate includes a straight rearward side edge of a length at least as great as that of said forward side edge of said flue opening, and wherein said damper plate rearward side edge underlies and is disposed parallel to said flue opening forward side edge when said damper plate is disposed in said forward position.

3. The fuel burning heater as defined in claim 2 wherein said damper plate is doubled upon itself along said rearward side edge, whereby a double thickness of said damper plate underlies said forward edge of said flue opening when said damper plate is in said forward position, to thereby further insulate said forward edge of said flue opening from the heat of combustion.

4. The fuel burning heater as defined in any one of claims 1, 2 or 3 wherein said heater further commprises a hearth plate extending forwardly from said front wall below said access opening and laterally along at least substantially the full width of said front wall, said hearth plate comprising an inner flat horizontal portion and an upwardly inclined outer flat edge portion whereby the outer edge portion acts to reflect radiant heat back toward the heater and thereby lower the temperature of an adjacent floor surface.

5. A fuel burning heater characterized as having a relatively low temperature on the top wall thereof so as to minimize warpage and deterioration of such wall, and comprising a front wall, a back wall, opposite side walls, a bottom wall, and a top wall collectively defining an enclosed combustion chamber, an access opening in said front wall to permit access to said combustion chamber, a generally rectangular flue opening in said top wall and adjacent said back wall for communicating with a flue or the like, said flue opening including an elongate forward side edge, a relatively flat damper plate, said plate having a size at least sufficient to underlie and cover said flue opening and having a rearward edge of a length at least substantially equal to the length of said forward edge of said flue opening, and with said rearward edge of said plate being doubled upon itself to form a double thickness of the plate material, and means slideably mounting said damper plate within said combustion chamber immediately below and parallel to said top wall, and for movement between a rearward position substantially underlying and closing said flue opening and a forward position wherein said rearward edge of said plate generally underlies and is parallel to the forward edge of said flue opening to thereby insulate the forward edge of the top wall from the heat of combustion within said combustion chamber.

* * * * *